US006945518B1

(12) United States Patent
Chrysler

(10) Patent No.: US 6,945,518 B1
(45) Date of Patent: Sep. 20, 2005

(54) MODULAR LAWN CLIPPING BARRIER

(76) Inventor: Todd D. Chrysler, 1326 Carling Avenue, Oshawa, Ontario (CA) L1H 7P2

( * ) Notice: Subject to any disclaimer, the term of this patent is extended or adjusted under 35 U.S.C. 154(b) by 114 days.

(21) Appl. No.: 10/672,873

(22) Filed: Sep. 29, 2003

(51) Int. Cl.[7] ..... E04H 17/16
(52) U.S. Cl. ..... 256/25; 256/24; 256/26
(58) Field of Search ..... 256/24, 25, 26

(56) References Cited

U.S. PATENT DOCUMENTS

| | | | | |
|---|---|---|---|---|
| 42,166 | A * | 4/1864 | Clapp et al. | 256/26 |
| 4,380,327 | A | 4/1983 | Fish | |
| 4,671,495 | A * | 6/1987 | Garland et al. | 256/12.5 |
| 5,054,507 | A * | 10/1991 | Sparks | 135/97 |
| 5,152,508 | A | 10/1992 | Fish | |
| 5,402,988 | A * | 4/1995 | Eisele | 256/24 |
| 5,531,427 | A * | 7/1996 | Quarles | 256/22 |
| 5,664,769 | A | 9/1997 | Sadinsky et al. | |
| 5,795,099 | A | 8/1998 | Parker | |
| 6,123,321 | A | 9/2000 | Miller | |
| 6,257,559 | B1 * | 7/2001 | Mouri | 256/26 |
| 6,676,113 | B2 * | 1/2004 | Christensen et al. | 256/25 |

* cited by examiner

*Primary Examiner*—Gary S. Hartmann

(57) ABSTRACT

A modular lawn clipping barrier includes a plurality of barrier sections that are removably coupled together. Each of a plurality of hinge members is attached to one of the plurality of barrier sections. Each of the hinge members comprises a first mating section and a second mating section. The first and second mating sections are attached to opposite ends of the barrier sections such that the first mating sections barrier sections may be aligned with the second mating sections of adjacently positioned barrier sections. Each of a plurality of rods is selectively extendable through a mated pair of the first and second mating sections such that mated pair are pivotally coupled together.

7 Claims, 4 Drawing Sheets

MODULAR LAWN CLIPPING BARRIER

BACKGROUND OF THE INVENTION

1. Field of the Invention

The present invention relates to barrier devices and more particularly pertains to a new barrier device for preventing lawn clippings from entering a designated area.

2. Description of the Prior Art

The use of barrier devices is known in the prior art. U.S. Pat. No. 6,123,321 describes a modular fence for the retaining of children or pets. Another type of barrier device is U.S. Pat. No. 5,664,769 having a tensioned fence for positioning around a pool.

While these devices fulfill their respective, particular objectives and requirements, the need remains for a device that is positionable around an area for preventing lawn debris from entering the area.

SUMMARY OF THE INVENTION

The present invention meets the needs presented above by including modular barrier sections which are selectively attachable together to form a barrier around a designated area.

Another object of the present invention is to provide a new barrier device that includes shafts which extend through the barrier sections and into a ground surface for supporting the barrier section in a vertical orientation.

Still another object of the present invention is to provide a new barrier device that includes foot members for supporting the barrier sections in a vertical orientation on a hardened surface.

To this end, the present invention generally comprises a plurality of barrier sections that are removably coupled together. Each of a plurality of hinge members is attached to one of the plurality of barrier sections. Each of the hinge members comprises a first mating section and a second mating section. The first and second mating sections are attached to opposite ends of the barrier sections such that the first mating sections barrier sections may be aligned with the second mating sections of adjacently positioned barrier sections. Each of a plurality of rods is selectively extendable through a mated pair of the first and second mating sections such that mated pair are pivotally coupled together.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
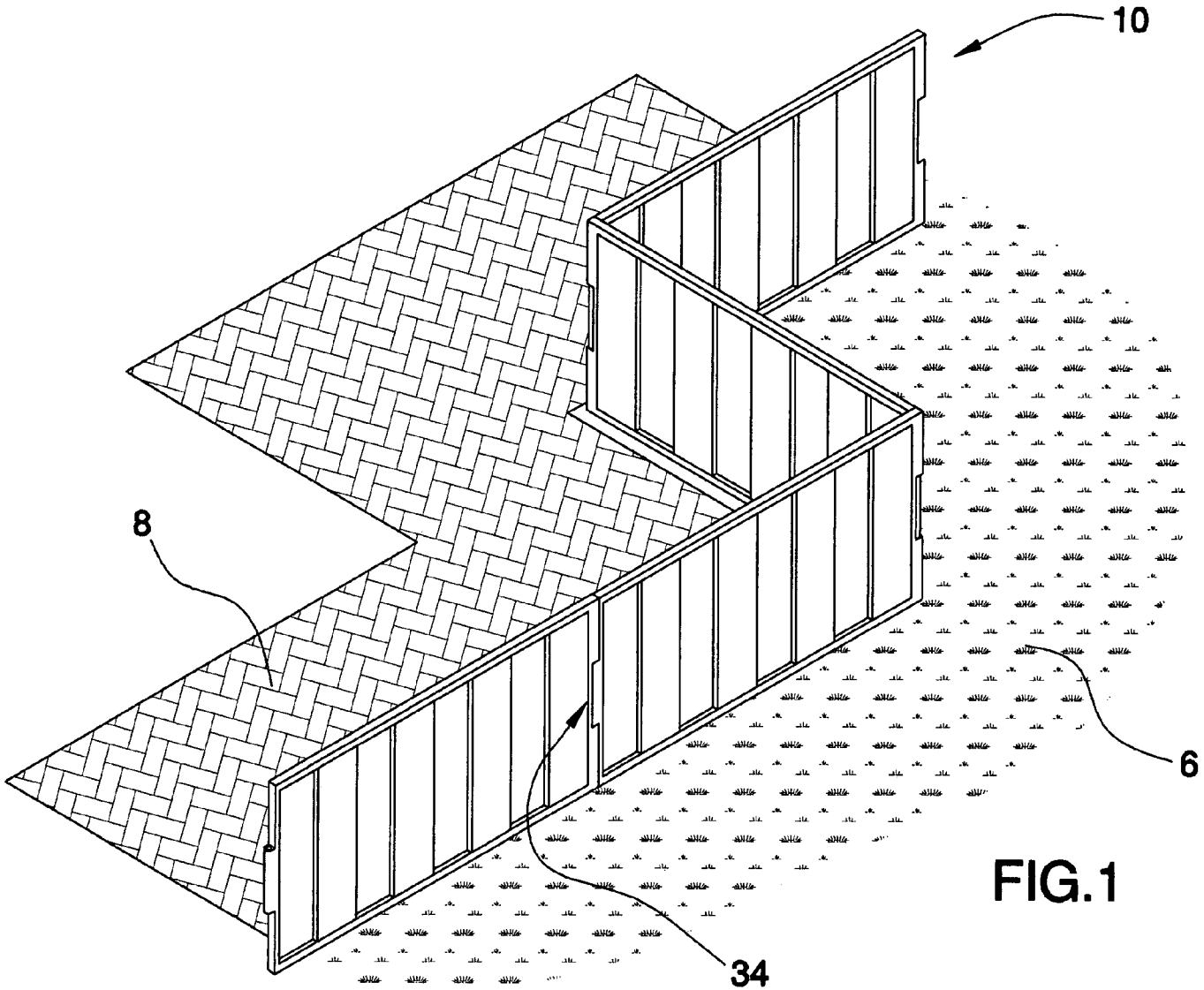
FIG. 1 is a schematic perspective view of a modular lawn clipping barrier according to the present invention.
Figure 2:
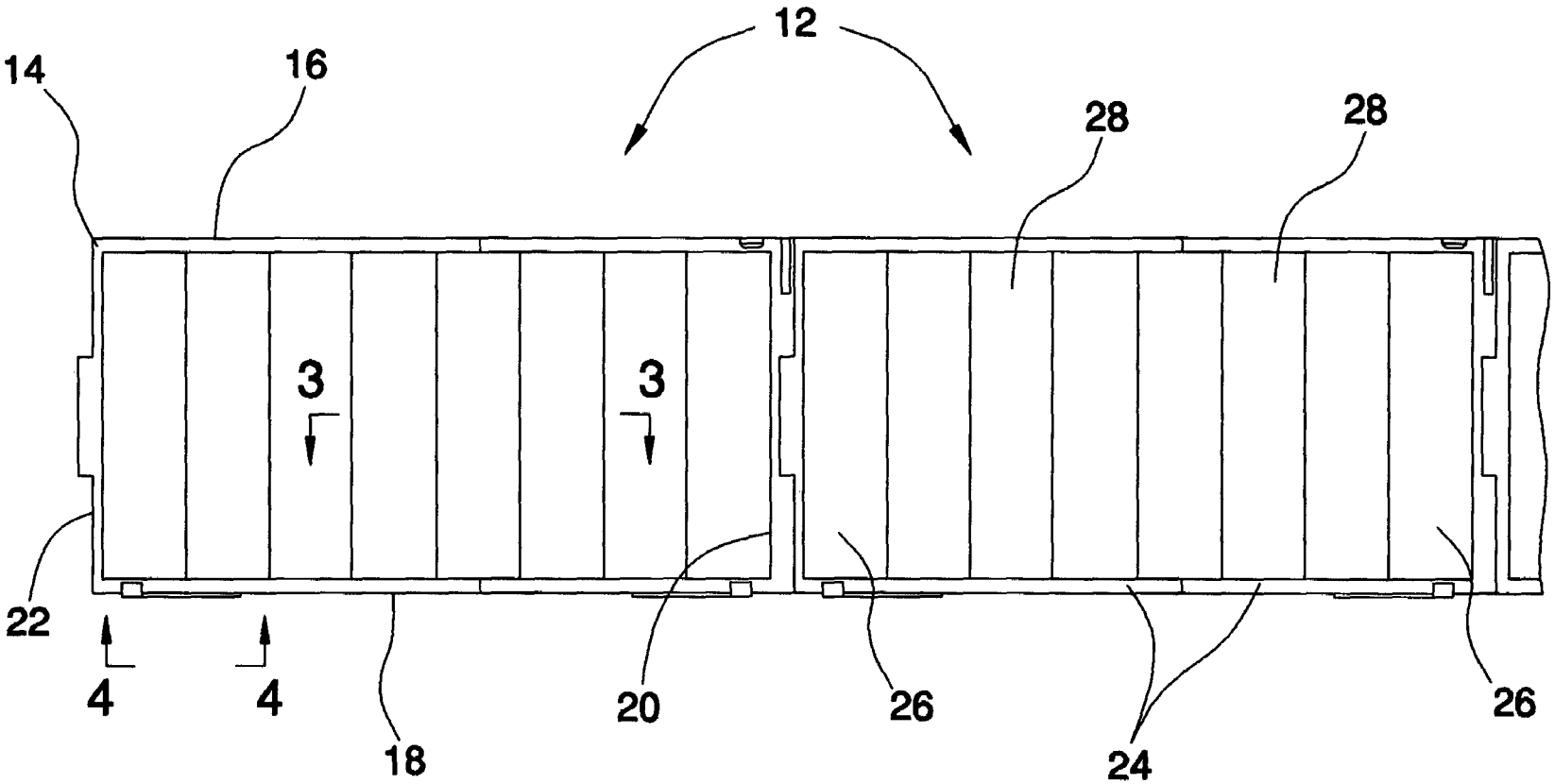
FIG. 2 is a schematic front view of the present invention.
Figure 3:
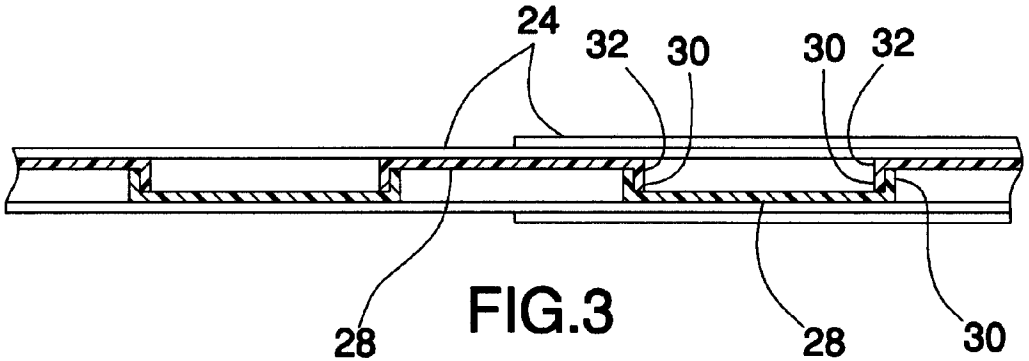
FIG. 3 is a schematic cross-sectional view taken along line 3-3 of FIG. 2 of the present invention.
Figure 4:
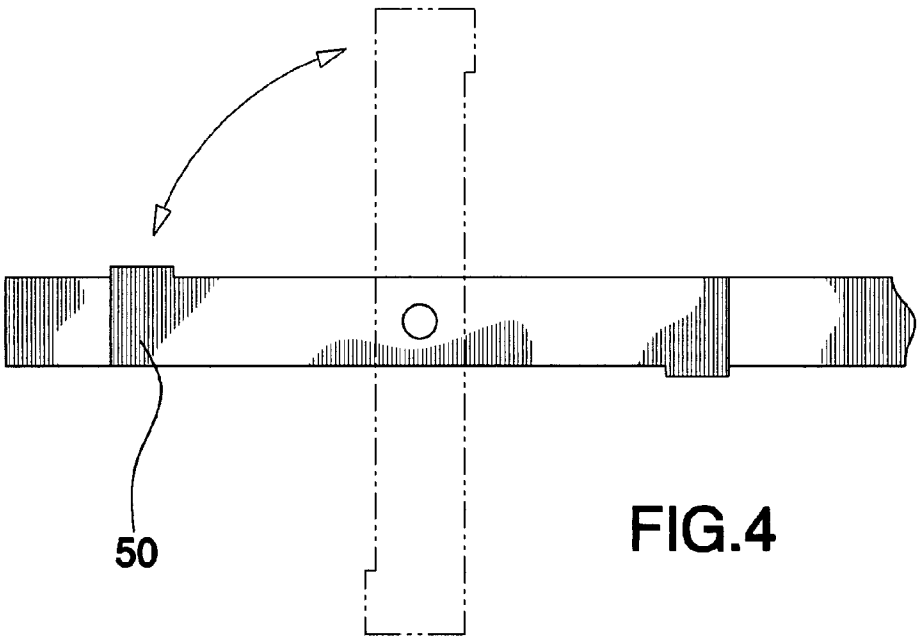
FIG. 4 is a schematic bottom view of the present invention.
Figure 5:
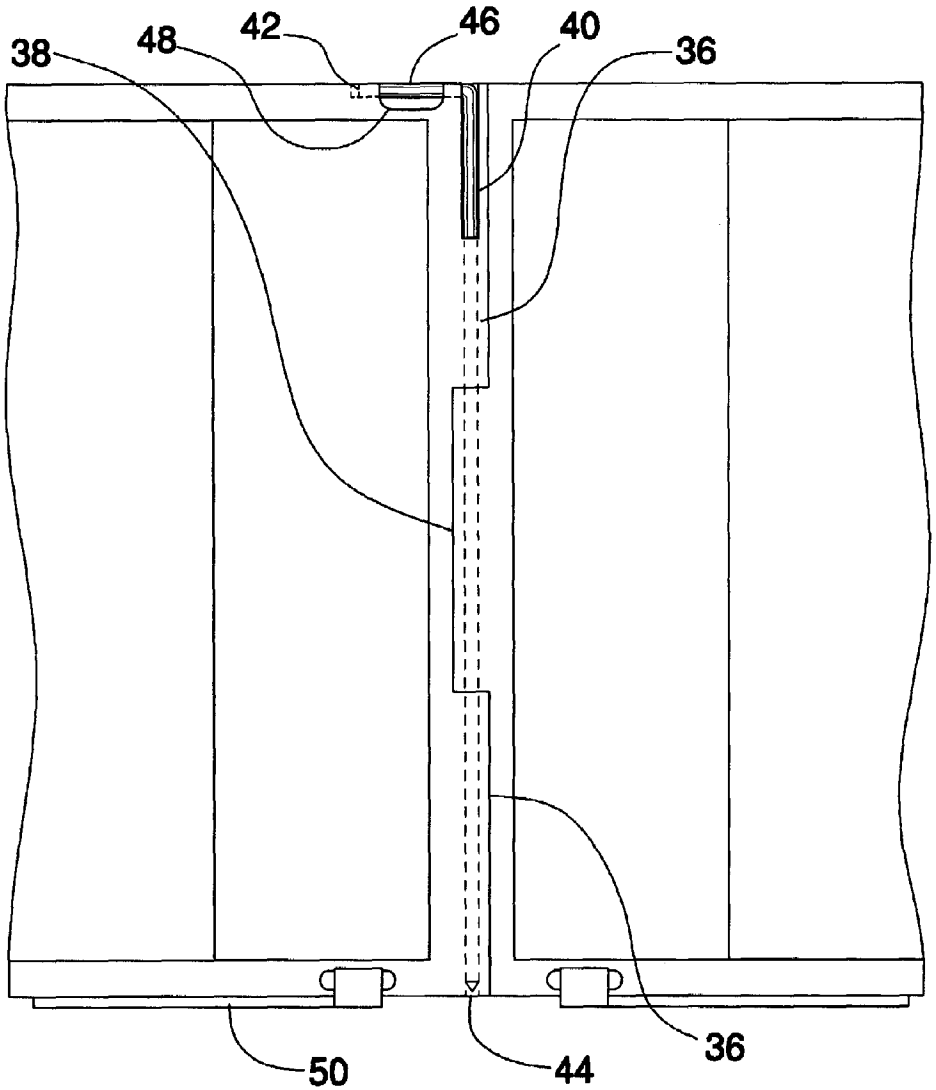
FIG. 5 is a schematic front view of the present invention.

With reference now to the drawings, and in particular to FIGS. 1 through 5 thereof, a new barrier device embodying the principles and concepts of the present invention and generally designated by the reference numeral 10 will be described.

As best illustrated in FIGS. 1 through 5, the modular lawn clipping barrier 10 generally comprises a plurality of barrier sections 12 that are removably coupled together. Each of the barrier sections 12 comprises a frame 14 having a top member 16, a bottom member 18, a first side member 20 and a second side member 22 attached together such that the frame 14 has a generally rectangular shape. The top 20 and bottom 22 members each comprise at least two sections 24. The sections 24 are slidably coupled to each other such that a distance between the first 20 and second 22 side members may be selectively altered. A height of the first 20 and second 22 side members is generally between 1 foot and 2 feet. A plurality of panels is mounted in each frame. The panels each extend between the top 20 and bottom 22 members. The panels include a pair of end panels 26 and a plurality of inner panels 28 positioned between the end panels 26. Each of the end panels 26 is positioned adjacent to one of the first 20 and second 22 side members. The end panels 26 are attached to their respective first 20 and second 22 side members. Each of the interior panels 28 is slidably coupled to adjacent ones of the plurality of panels 28. This may be accomplished with interlocking flanges 30 attached to each of the side edges 32 of the inner panels 28.

A plurality of hinge members 34 is used for coupling the barrier sections 12 together. Each of the hinge members 34 is attached to one of the plurality of barrier sections 12. Each of the hinge members 34 comprises a first mating section 36 and a second mating section 38. The first 34 and second 36 mating sections are attached to opposite ends of the barrier sections 12 such that the first mating sections 34 may be aligned with the second mating sections 36 of adjacently positioned barrier sections 12. The first 34 and second 36 mating sections are each preferably cylindrical members.

Each of a plurality of rods 40 is selectively extendable through a mated pair of the first 36 and second 38 mating sections such that the first 36 and second 38 mating sections are pivotally coupled together. The rods 40 each have an upper end 42 and lower end 44. The lower ends 42 are selectively extendable downwardly below the barrier sections 12 and into a ground surface 6. Each of the lower ends 44 is preferably pointed. Each of the rods is adjacent bent adjacent to the upper ends 42 such that a handle 46 is defined. Ideally, a slot 48 is positioned in an upper surface of each of the barrier sections 12 adjacent to the first mating section 36.

At least one of a plurality of foot members 50 is attached to a bottom surface of each of the barrier sections 12. Each of the foot members 50 comprises an elongated member pivotally coupled to the barrier sections 12 such that the elongated member may be selectively positioned within or perpendicular to a plane of the barrier sections.

In use, the barrier 10 is positioned adjacent to an area 8, such as a pool or patio, to prevent yard clippings and other debris from entering the area 8 while yard work is performed. The rods 40 are used to hold the barrier sections 12 in place by extending them into the ground surface 6. If the barrier sections 12 are positioned on a hardened area, the foot members 50 are turned so that they are outside of a plane of the barrier sections 12. In this position, they retain the barrier sections 12 in a vertical orientation. The barrier sections 12 are selectively retractable and extendable so that they can be fitted to the area needed. Additional barrier sections 12 may be added together as needed to form wall around the area 8.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modular barrier for preventing the spread of law clippings, said barrier comprising:

a plurality of barrier sections being removably coupled together, each of said barrier sections having a frame having a top member, a bottom member, a first side member and a second side member attached together such that said frame has a generally rectangular shape, each of said top and bottom members comprising at least two sections, said sections being slidably coupled to each other such that a distance between said first and second side members may be selectively altered; and a plurality of panels being mounted in said frame and extending between said top and bottom members, said panels including a pair of end panels and a plurality of inner panels positioned between said end panels, each of said end panels being positioned adjacent to one of said first and second side members, each of said interior panels being slidably coupled to adjacent ones of said plurality of panels;

a plurality of hinge members, each of said hinge members being attached to one of said plurality of barrier sections, each of said hinge members comprising a first mating section and a second mating section, said first and second mating sections being attached to opposite ends of said barrier sections such that said first mating sections may be aligned with said second mating sections of adjacently positioned barrier sections; and a plurality of rods, each of said of rods being selectively extendable through a mated pair of said first and second mating sections such that said first and second mating sections are pivotally coupled together.

2. The modular barrier of claim 1, each of said rods having an upper end and lower end, each of said lower ends being selectively extendable downwardly below said barrier sections and into a ground surface.

3. The modular barrier of claim 2, wherein each of said lower ends of said rods is pointed.

4. The modular barrier of claim 3, wherein each of said upper ends of said rods defines a handle.

5. The modular barrier of claim 1, further including a plurality of foot members, at least one of said foot members being attached to a bottom surface of each of said barrier sections.

6. The modular barrier of claim 5, wherein each of said foot members comprises an elongated member pivotally coupled to said barrier sections such that said elongated member may be selectively positioned within or perpendicular to a plane of said barrier sections.

7. A modular barrier for preventing the spread of lawn clippings, said barrier comprising:

a plurality of barrier sections being removably coupled together, each of said barrier sections comprising;

a frame having a top member, a bottom member, a first side member and a second side member attached together such that said frame has a generally rectangular shape, each of said top and bottom members comprising at least two sections, said sections being slidably coupled to each other such that a distance between said first and second side members may be selectively altered, a height of said first and second side members being generally between 1 foot and 2 feet;

a plurality of panels being mounted in said frame and extending between said top and bottom members, said panels including a pair of end panels and a plurality of inner panels positioned between said end panels, each of said end panels being positioned adjacent to one of said first and second side members, each of said interior panels being slidably coupled to adjacent ones of said plurality of panels;

a plurality of hinge members, each of said hinge members being attached to one of said plurality of barrier sections, each of said hinge members comprising a first mating section and a second mating section, said first and second mating sections being attached to opposite ends of said barrier sections such that said first mating sections may be aligned with said second mating sections of adjacently positioned barrier sections;

a plurality of rods, each of said of rods being selectively extendable through a mated pair of said first and second mating sections such that said first and second mating sections are pivotally coupled together, each of said rods having an upper end and lower end, each of said lower ends being selectively extendable downwardly below said barrier sections and into a ground surface, each of said lower ends being pointed, each of said upper ends defining a handle; and a plurality of foot members, at least one of said foot members being attached to a bottom surface of each of said barrier sections, each of said foot members comprises an elongated member pivotally coupled to said barrier sections such that said elongated member may be selectively positioned within or perpendicular to a plane of said barrier sections.

* * * * *